US007009128B1

(12) United States Patent
Czarnecki et al.

(10) Patent No.: US 7,009,128 B1
(45) Date of Patent: Mar. 7, 2006

(54) SIDE CONTACT ROCKER-TYPE SWITCH ASSEMBLY

(75) Inventors: Neil A. Czarnecki, Mt. Pleasant, WI (US); David D. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 51 days.

(21) Appl. No.: 10/755,735

(22) Filed: Jan. 12, 2004

(51) Int. Cl.
*H01H 3/00* (2006.01)

(52) U.S. Cl. ..... 200/339; 200/553

(58) Field of Classification Search ..... 200/1 R, 200/1 B, 1 V, 5 R, 553, 239, 557–559, 244–246, 200/284, 292, 294–296, 303, 307, 558, 6 R, 200/6 C
See application file for complete search history.

(56) References Cited

U.S. PATENT DOCUMENTS

| | | | | |
|---|---|---|---|---|
| 2,782,279 A | | 2/1957 | Heusser | |
| 3,225,156 A | | 12/1965 | Sahrbacker | |
| 3,671,693 A | | 6/1972 | Farrell | |
| 4,168,416 A | | 9/1979 | Josemans | |
| 4,789,766 A | | 12/1988 | Krause | |
| 4,808,775 A | * | 2/1989 | Satoh et al. | 200/1 V |
| 4,814,554 A | | 3/1989 | Magiera | |
| 5,105,059 A | | 4/1992 | Sorenson et al. | |
| 5,500,798 A | * | 3/1996 | Inagaki | 701/37 |
| 5,735,392 A | | 4/1998 | Shirasaka | |
| 5,753,874 A | * | 5/1998 | Kossakowski | 200/1 B |
| 6,091,038 A | * | 7/2000 | Murphy et al. | 200/563 |
| 6,175,090 B1 | | 1/2001 | Blossfeld | |
| 6,380,500 B1 | * | 4/2002 | Lin | 200/302.3 |
| 6,570,114 B1 | | 5/2003 | Czarnecki | |
| 6,596,956 B1 | * | 7/2003 | Czarnecki | 200/552 |
| 6,600,122 B1 | * | 7/2003 | Czarnecki et al. | 200/553 |
| 6,613,995 B1 | * | 9/2003 | Czarnecki et al. | 200/296 |
| 6,621,025 B1 | * | 9/2003 | Yei et al. | 200/315 |

* cited by examiner

*Primary Examiner*—Elvin Enad
*Assistant Examiner*—Lisa Klaus
(74) *Attorney, Agent, or Firm*—Boyle, Fredrickson, Newholm, Stein & Gratz, S.C.

(57) ABSTRACT

An electrical switch assembly is provided for use as a single-pole, double-throw switch. The assembly includes a housing having an interior cavity. First and second stationary contacts are positioned on one side of the interior cavity, and third and fourth stationary contacts are positioned on the other side of the interior cavity. A conductive member is interconnected between the first and third stationary contacts. A movable contact member is configured in one operative position to complete an electrical path between the first and the second stationary contacts, configured in a second operative position to complete an electrical path between the third and the fourth stationary contacts, and configured in an inoperative or OFF position to be electrically disconnected from all four stationary contacts. The improved switch assembly eliminates a center contact disposed in the housing, such that the switch assembly is less cumbersome and costly to manufacture and assemble.

23 Claims, 5 Drawing Sheets

SIDE CONTACT ROCKER-TYPE SWITCH ASSEMBLY

BACKGROUND AND SUMMARY OF THE INVENTION

This invention relates to an electrical switch assembly such as a single-pole, double-throw electrical switch, and more particularly to an improved construction of a rocker type switch assembly configured without a center contact.

A known rocker-type electrical switch assembly, such as a single pole double throw (SPDT) switch assembly, typically includes a housing having first and second stationary contacts mounted on opposite sides of an interior cavity. A stationary "center" contact is centrally located between the stationary first and second contacts. In the prior art, the center contact is channel-shaped and interconnected with a prong that extends from the bottom portion of the housing.

A V-shaped movable contact member or rocker formed of an electrically conductive material is engaged with and pivotable about the channel-shaped center contact. The V-shaped movable contact member includes a first leg and a second leg that are operable to selectively connect the center contact to either the first stationary contact or the second stationary contact in response to manual operation of an actuator movably mounted to the housing. Each leg of the V-shaped movable contact member carries a button-type contact that establishes contact with the underlying first or second stationary contacts. Upon the contact member establishing contact, a circuit path is completed from the respective first or second stationary contact and associated prong, through the V-shaped contact member, to the center contact, and on to the interconnected prong. The rocker type switch assembly can be used as a transfer switch assembly to selectively connect an electrical load between one of two separate power supplies, or as a switch assembly to selectively connect a power supply to one of two separate electrical loads.

FIG. 11 illustrates a center contact arrangement known in the art. The arrangement includes an electrically conductive U-shaped or channel shaped center contact 14 connected to a shaft 15 and a prong 16. The center contact 14 is configured to pivotally support a V-shaped contact member 17 having a number of button-type contacts at its ends.

When in an inoperative or OFF position, the V-shaped contact member 17 is positioned such that the button-type contacts are out of contact with a first 18 and a second stationary contact 19. The V-shaped contact member 17 remains in contact and is supported by the center contact 14. To place the switch in a first ON position, a plunger type actuator is pivoted relative to the switch housing to cause the V-shaped contact member 17 to rock or pivot on one of the walls of the center contact 14. One of the arms of the contact member 17 moves downwardly into engagement with underlying stationary contact 18, completing an electrical path from the stationary contact 18 through the contact member 17 to the center contact 14. When returned to the OFF position, the V-shaped contact member 17 pivots on the wall of the center contact 14, disengaging the contact member 17 from the stationary contact 18.

The center contact arrangement works in a similar fashion with respect to a second ON position, in which the other leg of the V-shaped contact member 17 establishes contact with the respective second contact 19, completing an electrical path from the second contact 19 through the contact member 17 to the center contact 14.

The known rocker-type transfer switch assembly has several drawbacks. For example, the first and the second contacts are located in close proximity to the center contact channel. Because of this proximity, arcing or short circuiting is possible when the first and second contacts are connected to separate electrical inputs. Furthermore, the configuration of the center contact area is cumbersome and inefficient to assemble.

SUMMARY OF THE INVENTION

It is an object of the present invention to provide an improved rocker-type switch assembly with a simplified design that is less cumbersome to manufacture, and yet functions in an effective manner to selectively connect a power supply between separate electrical loads, or selectively connect an electrical load between separate power supplies.

In accordance with one aspect, the present invention provides an electrical switch assembly that includes a first and a second stationary contact positioned on one side of the assembly, and a third and a fourth stationary contact positioned on an opposite of the assembly. A conductive member electrically connects the first and third stationary contacts. The switch assembly further includes a movable contact member configured to selectively establish an electrical path between the first and second stationary contacts in a first position, and configured to selectively establish an electrical path between the third and the fourth stationary contacts in a second position.

The movable contact member may include two pairs of arms. A first pair of arms is configured to selectively establish an electrical path between the first and second stationary contacts when the movable contact member is in the first position, and a second pair of arms is configured to establish an electrical path between the third and the fourth stationary contacts when the movable contact member is in the second position. The movable contact member can have a nonlinear configuration, such as in the form of a V-shaped member having the first and the second pairs of arms extending outwardly from a common center or apex. Each of the arms has a contact member secured toward its outer end to engage each of the four contacts. Furthermore, the movable contact member may be pivotable about four centering ears integrated into a housing forming a part of the switch assembly, and to which the stationary contacts are mounted.

In accordance with another aspect, the present invention provides an electrical switch assembly that includes a housing having an interior cavity. A first and a second stationary contact are positioned on one side of the interior cavity, and a third and a fourth stationary contact are positioned on the other side of the interior cavity. A movable contact member is configured in a first position to complete an electrical path between the first and the second electrical contacts, and is configured in a second position to complete an electrical path between the third and the fourth contacts, and is further configured in an inoperative or OFF position to be electrically disconnected from all four contacts.

The improved electrical switch assembly eliminates the center contact disposed in the housing, such that the switch assembly is less cumbersome to assemble and less costly to manufacture.

The invention also contemplates a method of selectively connecting an electrical load with a first power supply or a second power supply, substantially in accordance with the foregoing summary. In addition, the invention contemplates a method of selectively connecting an electrical power supply with a first electrical load or a second electrical load, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
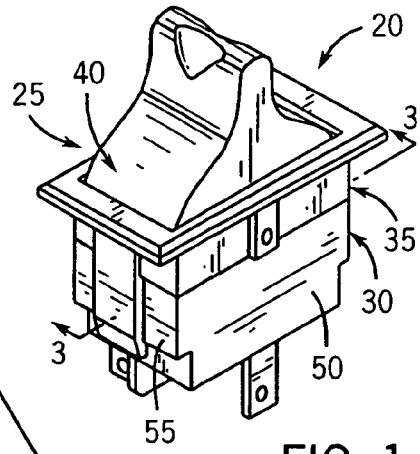
FIG. 1 is an isometric view of an assembled electrical switch assembly constructed in accordance with the present invention.
Figure 2:
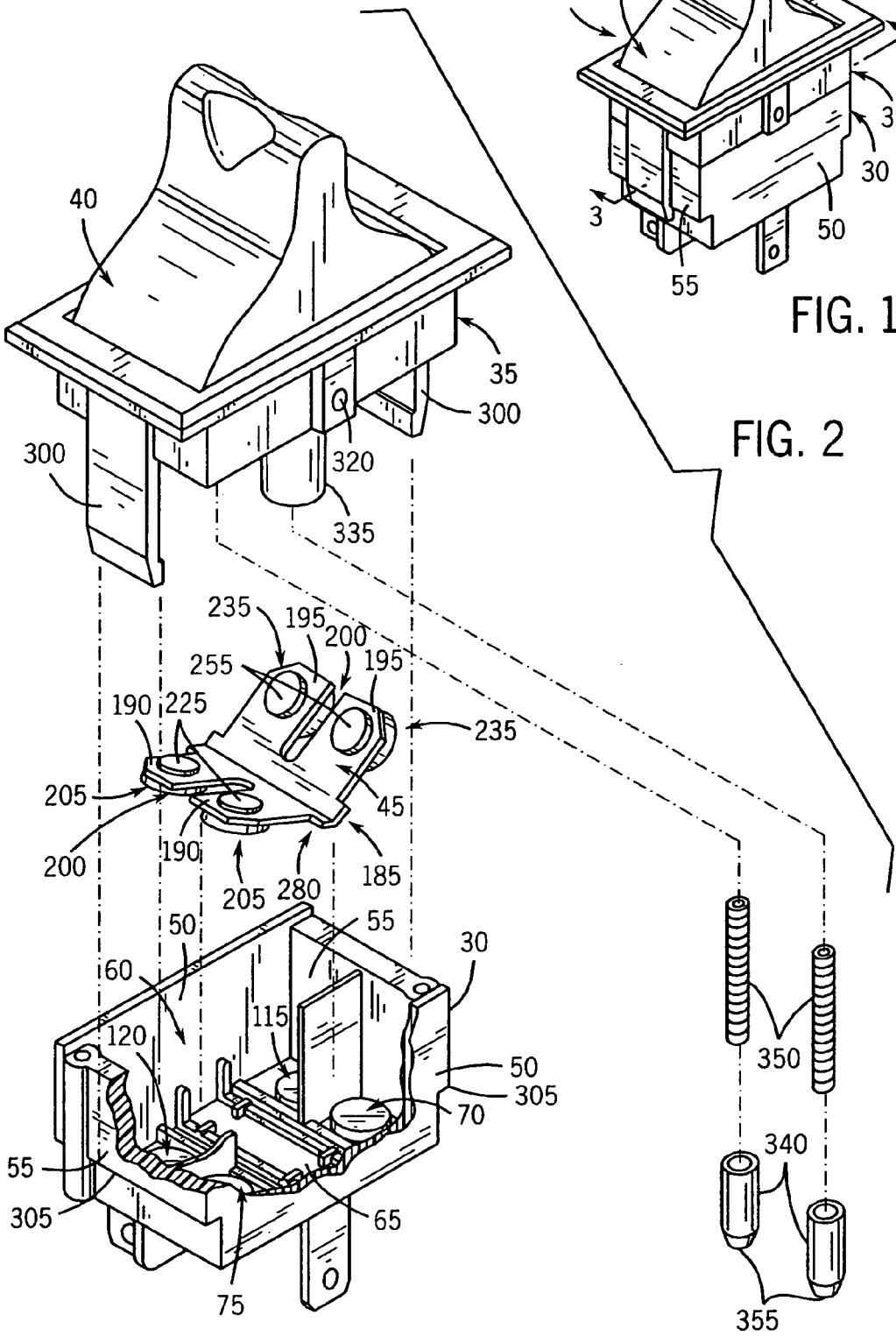
FIG. 2 is an exploded isometric view illustrating the components incorporated into the electrical switch of FIG. 1.

Referring to FIGS. 1 and 2, an electrical switch assembly 20 of the present invention generally includes a housing 25 made up of a base 30, a cover 35, and an actuator 40. The actuator 40 controls movement of a movable contact member 45 positioned within the housing 25.

Referring to FIGS. 1–6, the housing base 30 includes a pair of side walls 50 and a pair of end walls 55, which cooperate to define an internal cavity 60 within which the movable contact member 45 is received. The side walls 50 and the end walls 55 extend upwardly from a bottom wall 65, which defines the lower extent of the internal cavity 60.

Figure 6:
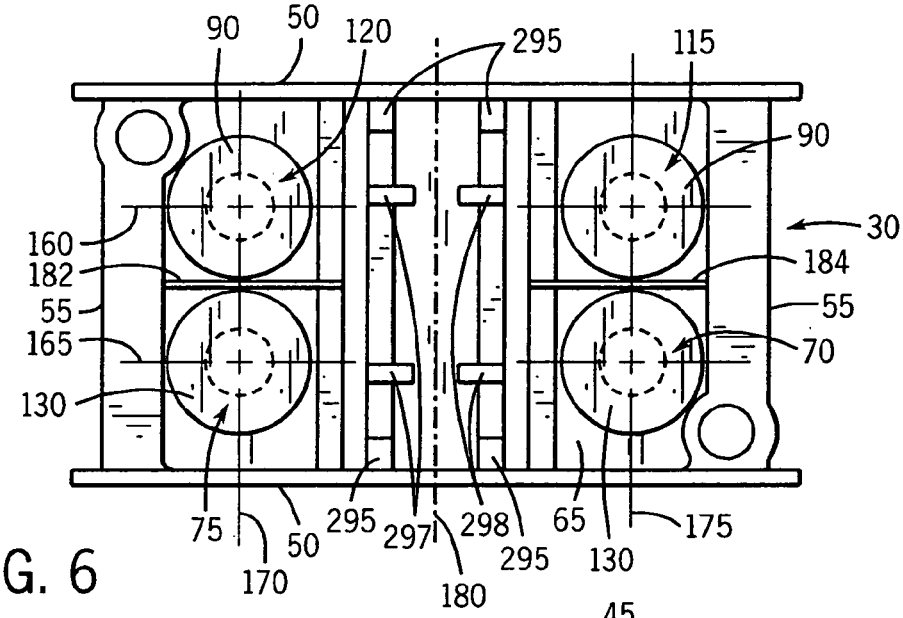
FIG. 6 is a section view taken along line 6—6 of FIG. 3.
Figure 10:
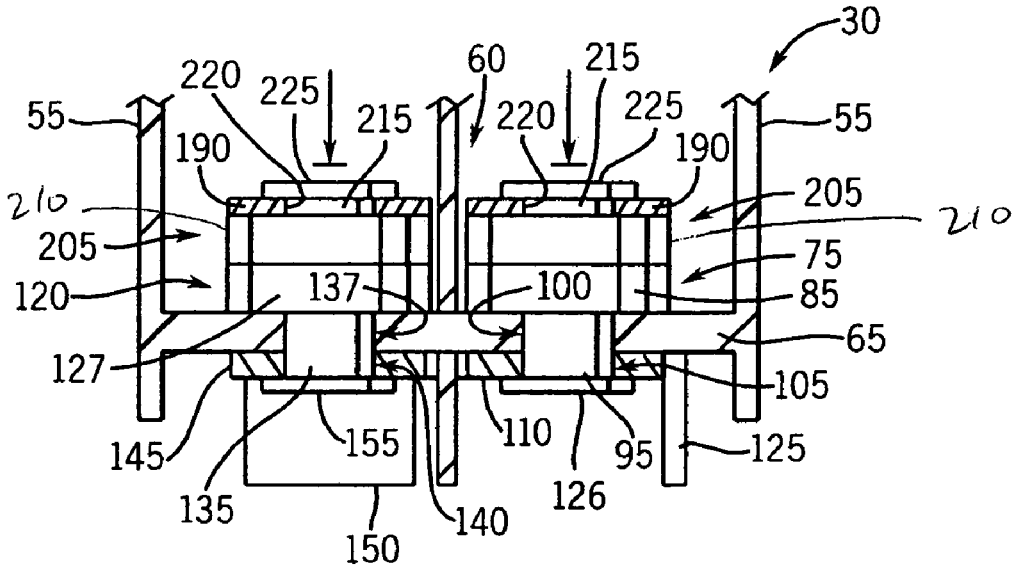
FIG. 10 is a partial section view taken along line 10—10 of FIG. 4.
Figure 11:
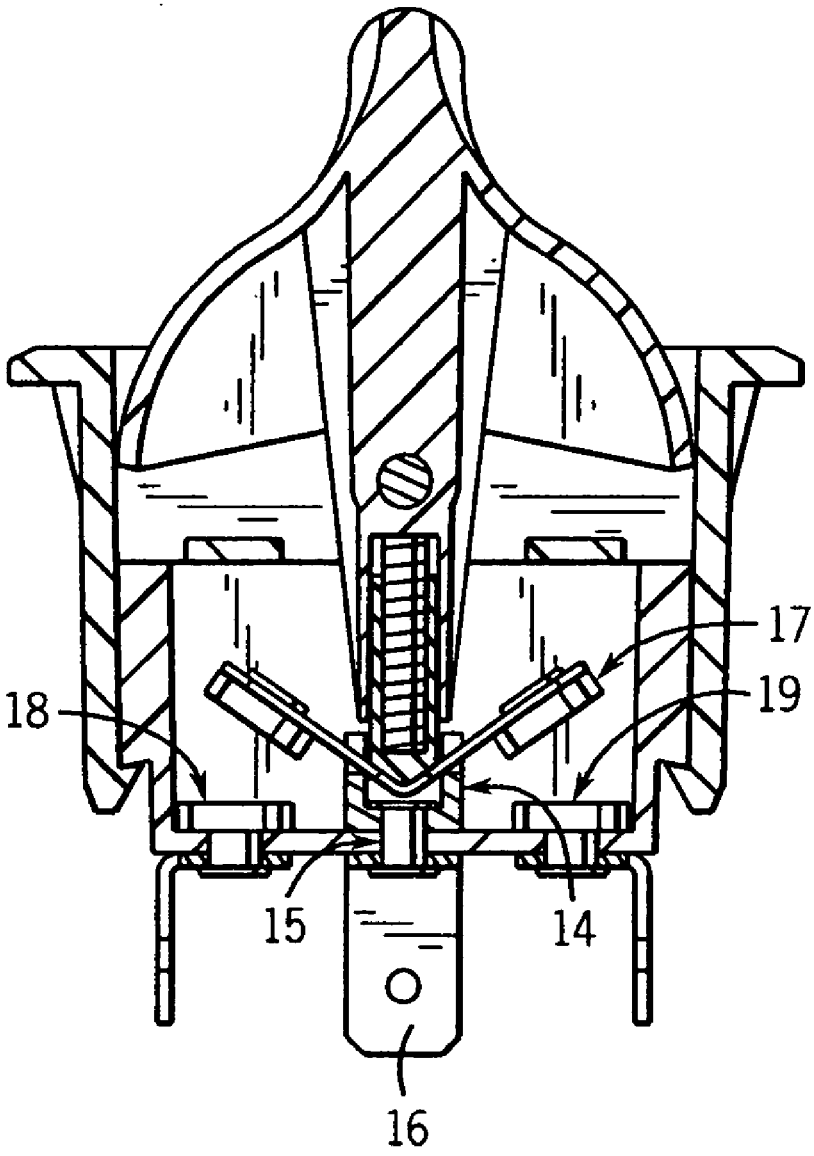
FIG. 11 (PRIOR ART)
FIG. 11 is a section view of a prior art switch assembly having a center contact member.

Referring to FIGS. 2, 6 and 10, a series of stationary contacts are secured to the bottom wall 65 of the housing base 30. The stationary contacts include a first contact 70 and a second contact 75. As illustrated in FIG. 10, each stationary contact 70 (not shown) and 75 includes a contact head 85 defining an upwardly facing contact surface 90, in combination with a shaft 95 that extends through an opening or aperture 100 formed in the bottom wall 65 of the housing base 30. Shaft 95 also extends through an aligned aperture 105 formed in a conductive strip 110 in engagement with the underside of the bottom wall 65. The conductive strip 110 is electrically connected to a depending prong 125 in accordance with conventional construction. A retainer head 126 is formed at the end of the shaft 95 opposite the contact head 85. The retainer head 126 maintains each contact 70 and 75 and the associated conductive strip 110 and prong 125 in engagement with the bottom wall 65, and establishes an electrical connection of each contact 70 and 75 with the conductive strip 110. The stationary contacts 70 and 75 and the bottom wall 65 are configured and arranged such that the upper contact surfaces 90 of contact heads 85 are generally coplanar.

As shown in FIGS. 2, 6, and 10, the series of stationary contacts further include a third stationary contact 115 and a fourth stationary contact 120. In a similar manner to stationary contacts 70 and 75 and as illustrated in FIG. 10, each stationary contact 115 (not shown) and 120 includes a contact head 127 defining an upwardly facing contact surface 130, in combination with a shaft 135 that extends through an opening 137 in the bottom wall 65. Each shaft 135 also extends through an aligned aperture 140 formed in a terminal strip 145, in engagement with the underside of the bottom wall 65. Each terminal strip 145 is electrically connected to a depending contact prong 150 in accordance with conventional construction. A retainer head 155 is formed at the end of each shaft 135 opposite the contact head 127. Each retainer head 155 maintains each contact 115 and 120 and its associated terminal strip 145 in engagement with the bottom wall 65, and establishes an electrical connection of each contact 115 and 120 with one of the terminal strips 145. Again, the stationary contacts 115 and 120 and the bottom wall 65 are configured and arranged such that the upper contact surfaces 130 of the contact heads 127 are generally coplanar with one another, as well as coplanar with the contact surfaces 90 of the contact heads 85 of the stationary contacts 70 and 75.

FIGS. 2 and 6 illustrate a first pair of contacts, namely contacts 70 and 115, and a second pair of contacts, namely contacts 75 and 120, located on opposite sides of the cavity 60. As will be understood, any number of contacts may be employed in the electrical switch assembly 20.

Referring to FIG. 6, stationary contact 70 is located directly opposite contact 75. Also, contact 115 is aligned with its respective opposite contact 120, such that a line 160 which intersects the centers of contacts 70 and 75 is parallel to a line 165 which intersects the centers of contacts 115 and 120. In addition, a line 170 which intersects the centers of contacts 70 and 115 is parallel to a line 175 which intersects the centers of contacts 75 and 120. Contacts 70 and 115 and contacts 75 and 120 are equally spaced from a central axis 180 of the bottom wall 65.

Still referring to FIG. 6, a first barrier 182 and a second barrier 184 are disposed between stationary contacts of opposite polarity. Specifically, the first barrier 182 is disposed between contacts 70 and 115, and the second barrier 184 is disposed between contacts 75 and 120. The barrier can be comprised of any non-conductive material known in the art, and may be formed integrally with the bottom wall 65.

Referring to FIGS. 2, 3, 7 and 10, the movable contact member 45 includes a central v-portion 185 connected to a first pair 190 and a second pair 195 of spaced apart contact arms. Each arm of the pairs of contact arms 190 and 195 is separated by a space 200, and each pair of contact arms 190 and 195 extend outwardly from the central v-portion 185. The first pair of spaced apart contact arms 190 extends outwardly in a first direction from the central v-portion 185, and the second pair of spaced apart contact arms 195 extends outwardly from the central v-portion 185 in a second direction opposite the first direction.

Figure 7:
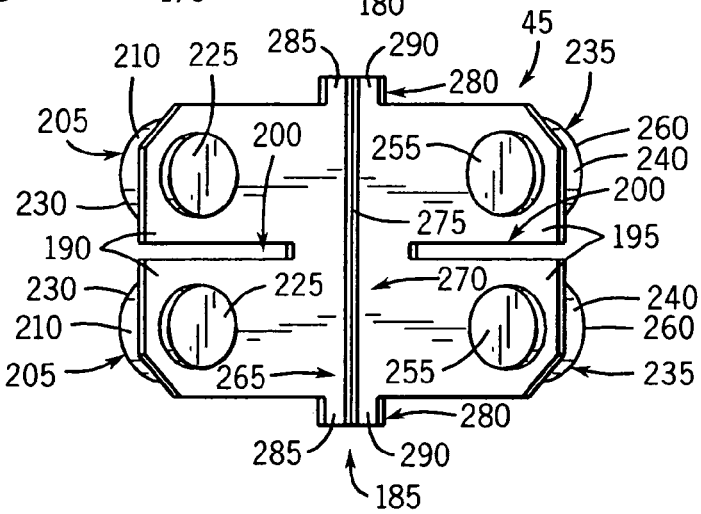
FIG. 7 is a plan view showing the movable contact member incorporated into the electrical switch of FIG. 1.

Referring to FIGS. 2, 7, 8 and 10, a rivet-type movable contact 205 is connected toward the outer end of each contact arm 190. The movable contact 205 includes a contact head 210, a shaft 215 that extends through an aperture 220 formed in the contact arms 190 and 195, and a retainer head 225. The retainer head 225 serves to secure each movable contact 205 to its associated contact arm 190 and establishes an electrical connection between the movable contact 205 and the contact arms 190. Referring to FIG. 7, the contact head 210 of each movable contact 205 defines a downwardly facing movable contact surface 230.

Similarly, a movable contact 235 is secured toward the outer end of each contact arm 195. Referring to FIGS. 2, 3, 7 and 10, each movable contact 235 includes a contact head 240, a shaft extending through an aperture (similar to shaft 215 and aperture 220 in FIG. 10) formed toward the outer end of each second contact arm 195, and a retainer head 255 on the opposite side of each second contact arm 195. As illustrated in FIG. 7, the retainer head 255 secures the movable contact 235 to its associated contact arm 195 and establishes an electrical connection therebetween. The contact head 240 of each movable contact 235 defines a downwardly facing movable contact surface 260.

Figure 3:
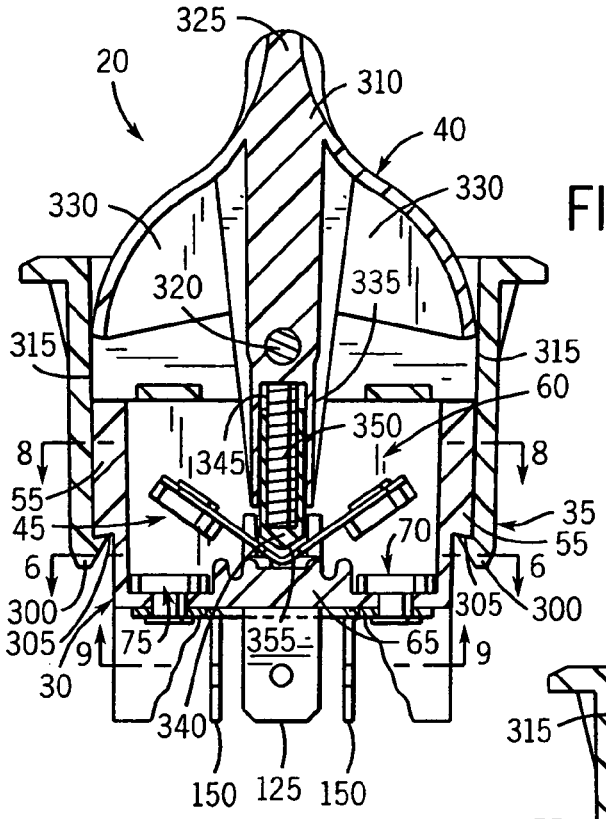
FIG. 3 is a section view along 3—3 of FIG. 1, showing the movable contact member in an inoperative or OFF position.

Still referring to FIGS. 2, 3 and 7, the central v-portion 185 of movable contact member 45 is in the form of a V-shaped member made up of a first planar wall 265 and a second planar wall 270, which intersect at a vertex 275. The central v-portion 185 and respective vertex 275 approximately spans between the walls 50 of the housing 25.

Referring to FIGS. 2, 6, 7 and 8, a V-shaped retainer tab 280 extends outwardly from each side of movable contact member 45. Each tab 280 includes intersecting tab walls 285 and 290, which are in the form of outward extensions of the central v-portion 185 of the first 265 and second 270 planar walls, respectively. When positioned within the cavity 60 of the housing base 30, each tab 280 of the movable contact member 45 is positioned between spaced apart retaining ridges 295 extending from the walls 50 of the housing 25.

Figure 8:
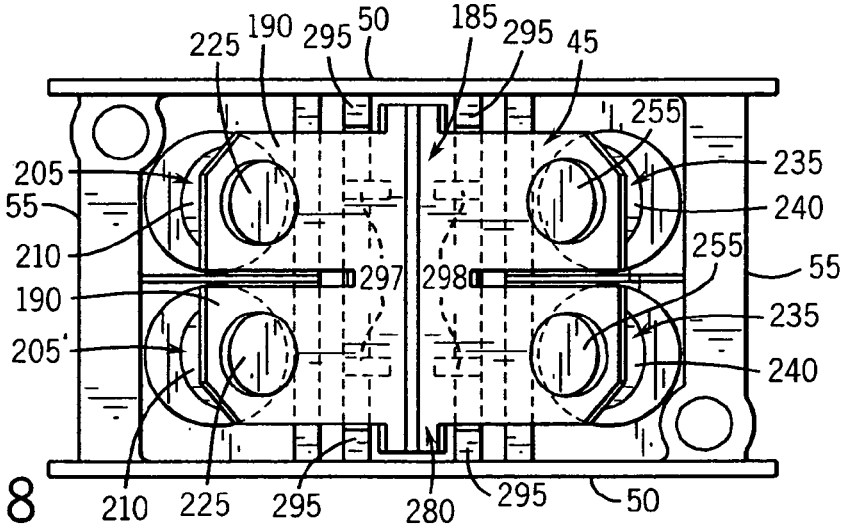
FIG. 8 is a section view taken along line 8—8 of FIG. 3.
Figure 9:
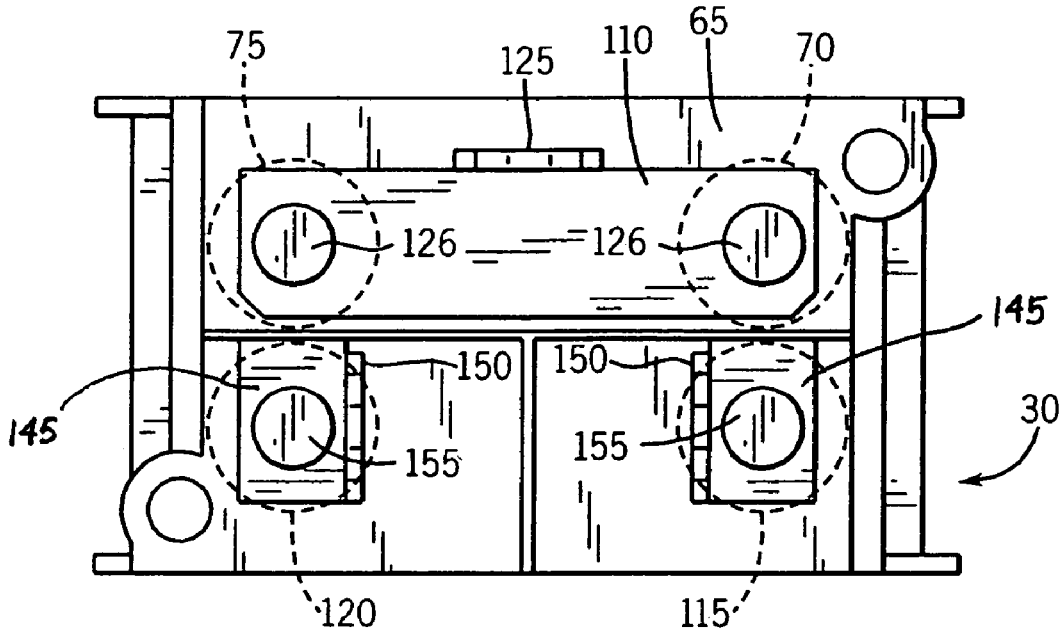
FIG. 9 is a bottom plan view of the electrical switch assembly of the present invention, with reference to line 9—9 of FIG. 3.

Referring to FIGS. 6–8, the v-portion 185 of the movable contact member 45 pivots in the housing 25 about a first pair 297 and a second pair 298 of centering ears. The first pair of centering ears 297 is configured to engage the first planar wall 265, and the second pair of centering ears 298 is configured to engage the second planar wall 270. The first 297 and the second 298 pair of centering ears may be integrated into the bottom wall 65 of the housing base 30.

Referring to FIGS. 2, 3 and 7, the first pair of spaced apart contact arms 190 of the movable contact member 45 is coplanar with each other and with the first planar wall 265 of the central v-portion 185. Similarly, the second pair of spaced apart contact arms 195 is coplanar with each other and with the second planar wall 270 of the central v-portion 185. The first 190 and the second 195 pairs of contact arms are formed integrally with the central v-portion 185, and are in the form of outward extensions of the first 265 and the second 270 planar walls, respectively. With this construction, the first 190 and the second 195 pairs of contact arms are formed integrally with the material of the central v-portion 185. The movable contact member 45 is preferably formed of a conductive material, e.g. copper plated with fine silver, although it is understood that any other satisfactory material may be employed.

Referring to FIGS. 2–3, the housing cover 35 is configured to engage with the upper ends of the housing base side walls 50 and end walls 55, and cooperates with the actuator 40 to enclose the internal cavity 60 defined by the housing base 30. The general structure and assembly of the base 30, the cover 35, and the actuator 40 are known in the art. In a manner as is known, the cover 35 includes a pair of flexible retaining fingers 300 configured to engage with a retaining surface 305 defined by the housing base 30, so as to secure the cover 35 to the base 30.

The actuator 40 includes an actuator member 310 pivotally mounted between spaced apart side walls 315 of the cover 35 via a pivot pin 320. The actuator member 310 includes a manually engageable actuator tab 325 in combination with a pair of wings 330 that extend downwardly and outwardly from the actuator tab 325. The wings 330 function to enclose the upper end of the base internal cavity 60 when the cover 35 and the actuator 40 are mounted to the housing base 30.

The actuator member 310 further includes a pair of barrel sections 335 located inwardly of the pivot pin 320. An actuating plunger 340 is mounted for inward-outward movement within a passage 345 defined by each barrel section 335. A spring 350 is received within the passage 345 and biases the plunger 340 in a downward or an outward direction. The plunger 340 includes a generally conical outer end or tip 355 configured to engage and provide movement of the movable contact member 45 in response to pivoting movement of the actuator member 310 about the pivot pin 320.

Figure 4:
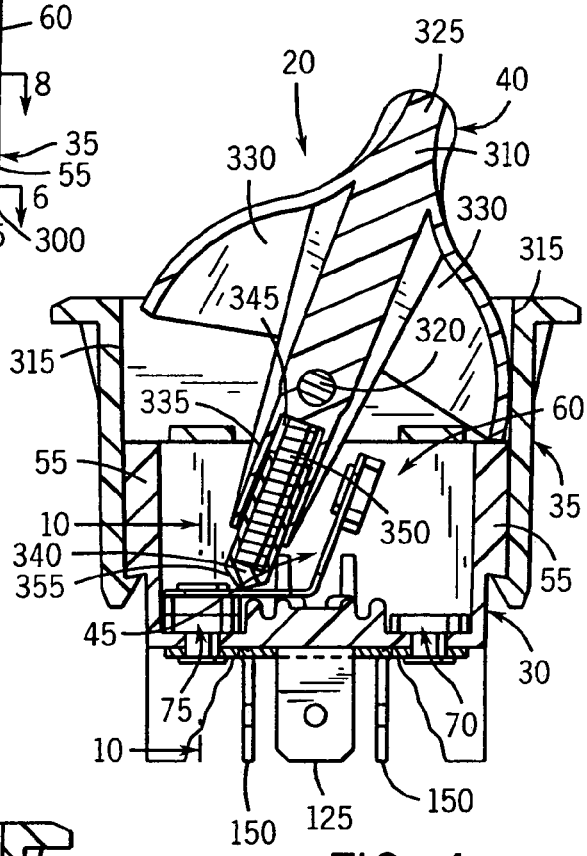
FIG. 4 is a section view similar to FIG. 3, showing the movable contact member in a first operative position.
Figure 5:
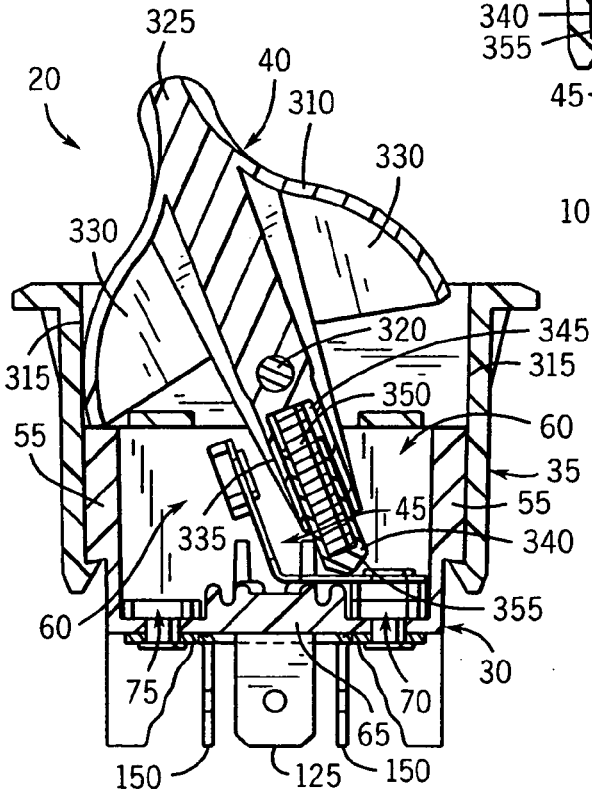
FIG. 5 is a section view similar to FIGS. 3 and 4, showing the movable contact member in a second operative position.

In operation and as illustrated in FIGS. 3–5, the electrical switch assembly 20 functions as follows. It is understood that the electrical switch assembly 20 may be connected as a switch that is operable to selectively connect an electrical power supply to one of two separate electrical loads. Electrical power is supplied to the contacts 70 and 75 via the conductive strip 110 and connected prong 125, for selective connection to one of a pair of electrical loads interconnected with the electrical switch assembly 20 via the stationary contacts 115 and 120 and their associated respective terminal strips 145 and prongs 150. Alternatively, the electrical switch assembly 20 may be connected as a transfer switch. When the electrical switch assembly 20 is connected as a transfer switch, two separate electrical power supplies are connected to the stationary contacts 115 and 120, respectively, and a single load is connected to the stationary contacts 70 and 75 via the connected the conductive strip 110 and prong 125.

To prevent connection between the stationary contacts 70 and 115, or between the stationary contacts 75 and 120, the electrical switch assembly 20 is maintained in its inoperative or OFF position of FIG. 3, in which actuator member 310 is in an intermediate position and neither of movable contacts 205, nor movable contacts 235, are engaged with the respective underlying respective stationary contacts 70, 75, 115, and 120. Typically, a detent arrangement is interposed between the cover 35 and the actuator member 310 for maintaining the movable contact member 45 in its inoperative position of FIG. 3. In this position, the conical tip 355 of each plunger 340 is engaged with the vertex 275 of the v-portion 185 of the movable contact member 45, forcing the vertex 275 against each pair of centering ears 297 and 298 of the housing base 30. The conical tip 355 is angled in a manner so as to correspond with the angle between the first 265 and second 270 walls, respectively, of the v-portion 185, to prevent movement of movable contact member 45 from its inoperative position.

To establish an electrical connection between the stationary contact 75 and the stationary contact 120, the actuator member 310 is pivoted in a clockwise direction about the pivot pin 320 toward the first operative position of FIG. 4. This operative position functions to either interconnect a first electrical load connected to stationary contact 120 with a power supply connected with contacts 70 and 75, or to connect a first power supply connected to contact 120 with an electrical load connected with the contacts 70 and 75. The pivoting movement of the actuator member 310 functions to slide the plungers 340 in an outward direction from the vertex 275 and toward the first movable contacts 205. The vertex 275 of the movable contact member 45 acts as a pivot about which movable contact member 45 rocks in a counterclockwise fashion, to bring movable contact surfaces 230 of movable first contacts 205 into engagement with the upper contact surfaces 90 and 130 of the stationary contacts 75 and 120, respectively. The barrel sections 335 and the plungers 340 are oriented such that each spring 350 provides a primarily downward force on the first contact arms 190 so as to urge the movable first contacts 205 into engagement with the stationary contacts 75 and 120. Simultaneously, the downward force applied by each plunger 340 is operable to maintain engagement of the portion of first wall 265 adjacent to vertex 275 with the centering ears 297 of the bottom wall 65.

In the position shown in FIG. 4, the plunger 340 is in engagement with each of the contact arms 190, which are flexible and resilient relative to the v-portion 185 of the movable contact member 45. The space 200 between the contact arms 190 allows the plungers 340 to flex the contact arms 190 in different amounts as required so as to establish full contact with the stationary contacts 75 and 120. This feature is illustrated in FIG. 10. Initial movement of movable contact member 45 may result in one of movable contacts 205 being spaced slightly above its associated stationary contact 75 or 120. As shown in FIG. 10, application of the biased downward forces (shown as arrows) exerted by the plungers 340 functions to flex the first contact arms 190 downwardly so as to engage the movable first contact 205 with the stationary contacts 75 and 120.

To break the connection with the stationary contacts 75 and 120, an operator moves the actuator member 310 to the inoperative position of FIG. 3. To then establish a connection between stationary contacts 70 and 115, the operator pivots the actuator member 310 in a counterclockwise direction to a position as shown in FIG. 5, which causes the clockwise pivoting movement of the movable contact member 45. In the same manner described previously, this clockwise movement of the movable contact member 45 results in the inner portion of second planar wall 270 of the v-portion 185 to move into engagement with centering ears 298, and causes the movable second contacts 235 to move into engagement with the stationary contacts 70 and 115. In the same manner as described previously, the space 200 between the contact arms 195 enables the contact arms 195 to flex relative to one another and relative to the central v-portion 185, to ensure proper engagement of the movable second contacts 235 with the stationary contacts 70 and 115.

The configuration of the movable contact member 45 and the stationary contacts 70, 75, 115 and 120 is such that the movable contact member 45 moves smoothly between its various positions simply by selectively "rocking" the central v-portion 185 on the centering ears 297 and 298 of the housing base 30. The flexibility of the arms 190 and 195 ensures that the movable contact member 45 is in full contact with the stationary contacts 70, 75, 115 and 120 when the switch assembly 20 is placed in either of its operative positions. The provision of the v-portion 185 allows the movable contacts 205 and 235 to share a current load equally. The flexibility of the movable contact arms 190 and 195 allows each of the movable contacts 205 and 235 to seek its own seated position, so as to ensure proper electrical contact.

The tabs 280 of the movable contact member 45 are positioned between the respective retaining ridges 295 to maintain the position of the movable contact member 45 within the cavity 60 of the housing base 30. When movable contact member 45 is moved to one of its operative positions, such as the first operative position as shown in FIG. 4, the first pair of contact arms 190 of movable contact member 45 engages the upper edge of ears 297. Again, as illustrated in FIG. 10, the downward forces applied to the contact arms 190 by the plungers 340 functions to seat the movable contacts 205 on the stationary contacts 75 and 120. The proper sharing of the electrical current load is accomplished by the structure of the movable contact member 45.

The construction of the movable contact member 45 enables the electrical switch assembly 20 to be employed as a transfer switch, since it is impossible for contact to be established between the stationary contacts 115 and 120. In the event that one of the movable contacts 205 were to become welded to one of the stationary contacts 75 or 120, the movable contacts 235 cannot subsequently be moved toward a position in which the non-welded movable contacts 235 can be brought into engagement with one of the opposite stationary contacts 70 and 115, or vice versa, and thereby avoid creating a common connection of all of the movable contacts 205 and 235. The strength of the material of the movable contact member 45 is selected such that, in the event this were to occur, the biasing force applied by the associated plunger 340 is insufficient to flex the pairs of movable contact arm 190 or 195 by an amount sufficient to establish contact with stationary contacts of opposite polarity.

While the invention has been shown and described with respect to particular embodiments, it is understood that alternatives and modifications are possible and are contemplated as being within the scope of the present invention. For example, and without limitation, the spaced apart contact arms of the movable contact member are shown and described as being formed integrally with the material of the central v-portion. It is also contemplated that the separate arms of the movable contact member may be formed separately and connected to the central v-portion in any satisfactory manner. Further, the movable contact member has been shown and described as being formed of the material which itself is the conductor that establishes an electrical path between the first and the second contacts or the third and the fourth contacts. It is also contemplated that the movable contact member may be formed of a resilient material, such as plastic, and that the movable contacts and the central v-portion may be in the form of electrically conductive material connected with each other and carried by the movable contact member. In addition, while a specific type of construction is shown for providing pivoting movement of the movable contact member relative to the housing, it is contemplated that any other type of pivot or rocking connection may be employed. In addition, while the invention has been described with respect to two pairs of contact arms which extend outwardly from the center contact area, it is understood that any number of contact arms on either side of the center contact area may be employed. The number of contact arms may be equal or unequal, and the contact arms may be aligned with each other as shown or may be out of alignment with each other. Further, while a specific type of actuator has been shown and described, it is understood that any type of biased actuator which is capable of applying separate downward forces on the separate contact arms may be employed while still gaining the full advantages offered by the central v-portion and the spaced apart contact arms of the movable contact member of the present invention.

Various alternatives and embodiments are contemplated as being within the scope of the following claims particularly pointing out and distinctly claiming the subject matter regarded as the invention.

We claim:

1. An electrical switch assembly, comprising:

a first pair of stationary contacts positioned on a first side of the electrical switch assembly;

a second pair of stationary contacts positioned on a second side of the electrical switch assembly;

a movable contact member; and a conductive member electrically connecting one contact of the first pair of stationary contacts with one contact of the second pair of stationary contacts;

wherein the movable contact member is configured to selectively establish an electrical path between the first pair of stationary contacts in a first position, and wherein the movable contact member is configured to selectively establish an electrical path between the second pair of stationary contacts in a second position; and wherein the movable contact member connects the first pair of stationary contacts with one of the contacts of the second pair of contacts through the conductive member when the movable contact member is in the first position, and wherein the movable contact member connects the second pair of stationary contacts with one of the contacts of the first pair of contacts through the conductive member when the movable contact member is in the second position.

2. An electrical switch assembly, comprising:

a first pair of stationary contacts positioned on a first side of the electrical switch assembly;

a second pair of stationary contacts positioned on a second side of the electrical switch assembly;

a movable contact member; and a conductive member electrically connecting one contact of the first pair of stationary contacts with one contact of the second pair of stationary contacts;

wherein the movable contact member is configured to selectively establish an electrical path between the first pair of stationary contacts in a first position, and wherein the movable contact member is configured to selectively establish an electrical path between the second pair of stationary contacts in a second position, and wherein the movable contact member is configured to move to an inoperative position and electrically disconnect from all four stationary contacts.

3. The electrical switch assembly of claim 1, wherein the movable contact member includes a V-shaped section having a vertex between a first pair and a second pair of divergent arms that extend in an outward direction from the vertex in a non-linear fashion.

4. The electrical switch assembly of claim 3, further including:

a housing configured to enclose the switch assembly, wherein the housing includes a first pair and a second pair of centering ears disposed on each side of the V-shaped section.

5. The electrical switch assembly of claim 4, wherein the movable contact member is operable to pivot about the first and second pairs of centering ears.

6. The electrical switch assembly of claim 1, wherein the movable contact member is configured to move to an inoperative position and electrically disconnect from all four stationary contacts.

7. The electrical switch assembly of claim 3, wherein the electrical switch assembly does not include a center contact configured to engage the V-shaped section of the movable contact member.

8. The electrical switch assembly of claim 1, wherein the movable contact member is configured in a first ON position to engage the first pair of stationary contacts, and is configured in a second ON position to engage the second pair of stationary contacts, and is configured in an OFF position to be electrically disconnected from all four of the stationary contacts.

9. An electrical switch assembly, comprising:

a first pair of stationary contacts positioned on a first side of the electrical switch assembly;

a second pair of stationary contacts positioned on a second side of the electrical switch assembly;

a movable contact member; and a conductive member electrically connecting one contact of the first pair of stationary contacts with one contact of the second pair of stationary contacts;

wherein the movable contact member is configured to selectively establish an electrical path between the first pair of stationary contacts in a first position, and wherein the movable contact member is configured to selectively establish an electrical path between the second pair of stationary contacts in a second position;

wherein the movable contact member includes a V-shaped section having a vertex between a first pair and a second pair of divergent arms that extend in an outward direction from the vertex in a non-linear fashion, and wherein the electrical switch assembly does not include a center contact configured to engage the V-shaped section of the movable contact member.

10. An electrical switch assembly, comprising:

a first pair of stationary contacts positioned on a first side of the electrical switch assembly;

a second pair of stationary contacts positioned on a second side of the electrical switch assembly;

a movable contact member; and a conductive member electrically connecting one contact of the first pair of stationary contacts with one contact of the second pair of stationary contacts;

wherein the movable contact member is configured to selectively establish an electrical path between the first pair of stationary contacts in a first position, and wherein the movable contact member is configured to selectively establish an electrical path between the second pair of stationary contacts in a second position, and wherein the movable contact member is configured in a first ON position to engage the first pair of stationary contacts, and is configured in a second ON position to engage the second pair of stationary contacts, and is configured in an OFF position to be electrically disconnected from all four of the stationary contacts.

11. An electrical switch assembly comprising:

a first pair of stationary contacts positioned on a first side of the electrical switch assembly;

a second pair of stationary contacts positioned on a second side of the electrical switch assembly;

a movable contact member;

a conductive member electrically connecting one contact of the first pair of stationary contacts with one contact of the second pair of stationary contacts; and a barrier disposed between the first and the second contacts;

wherein the movable contact member is configured to selectively establish an electrical path between the first pair of stationary contacts in a first position, and wherein the movable contact member is configured to selectively establish an electrical path between the second pair of stationary contacts in a second position.

12. An electrical switch assembly, comprising:

a first pair of stationary contacts positioned on a first side of the electrical switch assembly;

a second pair of stationary contacts positioned on a second side of the electrical switch assembly;

a movable contact member;

a conductive member electrically connecting one contact of the first pair of stationary contacts with one contact of the second pair of stationary contacts; and a barrier disposed between the third and the fourth contacts;

wherein the movable contact member is configured to selectively establish an electrical path between the first pair of stationary contacts in a first position, and wherein the movable contact member is configured to selectively establish an electrical path between the second pair of stationary contacts in a second position.

13. An electrical switch assembly, comprising:

a housing having an interior cavity;

a first pair of stationary contacts positioned on one side of the interior cavity;

a second pair of stationary contacts positioned on the other side of the interior cavity;

a movable contact member configured in a first position to complete an electrical path between the first pair of stationary contacts, and configured in a second position to complete an electrical path between the second pair of stationary contacts, and configured in an inoperative position to electrically disconnect from all four stationary contacts.

14. The electrical switch assembly of claim 13, wherein the movable contact member includes a first and a second pair of arms that extend from a V-shaped section.

15. The electrical switch assembly of claim 14, wherein the V-shaped section of the movable contact member is configured to pivot about a first and a second pair of centering ears disposed on the housing.

16. The electrical switch assembly of claim 14, wherein the moveable contact member includes a first and a second pair of legs, each leg having a contact portion configured to engage one of the four stationary contacts.

17. The electrical switch assembly of claim 13, wherein a barrier is disposed in the interior cavity of the housing between the first pair of stationary contacts.

18. The electrical switch assembly of claim 13, wherein a barrier is disposed in the interior cavity of the housing between the second pair of stationary contacts.

19. The electrical switch assembly of claim 13, further including an actuator mounted on the housing and configured to move the movable contact member to the first position, the second position, or the inoperative position.

20. A method of electrically selectively connecting an electrical load with a first electrical power supply or a second electrical power supply, the method comprising the steps of:

providing a switch having a first pair of adjacent contacts and a second pair of adjacent contacts, wherein the first pair of contacts and the second pair of contacts are spaced apart, and wherein the switch includes a conductive member between one of the contacts of the first pair of contacts and one of the contacts of the second pair of contacts;

connecting the electrical load with the conductive member;

connecting a first electrical power supply with one of the contacts of the first pair of contacts;

connecting a second electrical power supply with one of the contacts of the second pair of contacts; and selectively moving a movable contact member to a first operative position in which the movable contact member engages the first pair of contacts and establishes an electrical connection therebetween to connect the first electrical power supply with the electrical load through the conductive member, and a second operative position in which the movable contact member engages the second pair of contacts and establishes an electrical connection therebetween to connect the second electrical power supply with the electrical load through the conductive member.

21. The method of claim 20, wherein the step of selectively moving the movable contact member further includes moving the movable contact member to a third operative position in which the movable contact member is electrically disconnected from all four of the stationary contacts.

22. A method of switching electrical connection with an electrical power supply between a first electrical load and a second electrical load, the method comprising the steps of:

providing a switch having a first pair of adjacent contacts and a second pair of adjacent contacts, wherein the first pair of contacts and the second pair of contacts are spaced apart, and wherein the switch includes a conductive member between one of the contacts of the first pair of contacts and one of the contacts of the second pair of contacts;

connecting the electrical power supply to the conductive member;

connecting a first electrical load with one of the contacts of the first pair of contacts;

connecting a second electrical load with one of the contacts of the second pair of contacts; and selectively moving a movable contact member to a first operative position in which the movable contact member engages the first pair of contacts and establishes an electrical connection therebetween to connect the electrical power supply with the first electrical load through the conductive member, and a second operative position in which the movable contact member engages the second pair of contacts and establishes an electrical connection therebetween to connect the electrical power supply with the second electrical load through the conductive member.

23. The method of claim 22, wherein the step of selectively moving the movable contact member further includes moving the movable contact member to a third operative position in which the movable contact member is electrically disconnected from all four of the stationary contacts.

* * * * *